US008417188B1

(12) United States Patent
Vosburgh

(10) Patent No.: US 8,417,188 B1
(45) Date of Patent: Apr. 9, 2013

(54) SYSTEMS AND METHODS FOR INSPECTION AND COMMUNICATION IN LIQUID PETROLEUM PRODUCT

(75) Inventor: Frederick Vosburgh, Durham, NC (US)

(73) Assignee: iRobot Corporation, Bedford, MA (US)

( * ) Notice: Subject to any disclaimer, the term of this patent is extended or adjusted under 35 U.S.C. 154(b) by 612 days.

(21) Appl. No.: 12/693,081

(22) Filed: Jan. 25, 2010

Related U.S. Application Data

(60) Provisional application No. 61/149,484, filed on Feb. 3, 2009.

(51) Int. Cl.
*H04B 7/00* (2006.01)

(52) U.S. Cl.
USPC ..... 455/66.1; 455/90.3

(58) Field of Classification Search ..... 455/90.3, 455/66.1, 420; 340/853.1, 853.2, 854.1, 340/854.3, 618; 701/2
See application file for complete search history.

(56) References Cited

U.S. PATENT DOCUMENTS

| | | | | |
|---|---|---|---|---|
| 3,943,875 | A | 3/1976 | Sanders | |
| 4,009,434 | A | 2/1977 | McKinlay et al. | |
| 4,044,355 | A * | 8/1977 | Edvardsson | 342/124 |
| 5,447,115 | A | 9/1995 | Moody | |
| 5,551,363 | A * | 9/1996 | Cipolla et al. | 114/23 |
| 5,551,364 | A * | 9/1996 | Cipolla et al. | 114/23 |
| 5,748,102 | A | 5/1998 | Barron | |
| 5,773,913 | A * | 6/1998 | Casselden | 310/338 |
| 6,058,071 | A | 5/2000 | Woodall et al. | |
| 6,058,874 | A * | 5/2000 | Glenning et al. | 114/328 |
| 6,390,012 | B1 * | 5/2002 | Watt et al. | 114/322 |
| 6,597,175 | B1 * | 7/2003 | Brisco | 324/326 |
| 6,600,695 | B1 * | 7/2003 | Nugent et al. | 367/131 |
| 6,711,095 | B1 | 3/2004 | Daniels | |
| 6,738,314 | B1 * | 5/2004 | Teeter et al. | 367/131 |
| 6,961,657 | B1 | 11/2005 | Wernli et al. | |
| 6,974,356 | B2 * | 12/2005 | Hobson et al. | 440/13 |
| 7,064,677 | B2 * | 6/2006 | Newman | 340/854.6 |
| 7,075,454 | B2 * | 7/2006 | Hirsch et al. | 340/854.6 |
| 7,227,139 | B2 * | 6/2007 | Kram et al. | 250/301 |
| 7,301,474 | B2 * | 11/2007 | Zimmerman | 340/854.6 |
| 7,307,424 | B2 | 12/2007 | MacGregor et al. | |
| 7,495,999 | B2 | 2/2009 | Kemp et al. | |
| 8,224,594 | B2 * | 7/2012 | Sai | 702/55 |
| 8,234,084 | B2 * | 7/2012 | Wicht et al. | 702/55 |
| 2007/0096941 | A1 * | 5/2007 | Morys | 340/853.1 |
| 2008/0198007 | A1 * | 8/2008 | Chi-Jung | 340/540 |
| 2008/0225643 | A1 * | 9/2008 | Vosburgh | 367/131 |

(Continued)

OTHER PUBLICATIONS

Morrison, "Enhancing Oilfield Operations through Wireless Technology" OleumTech Corporation, http://www.ngoilgas.com/article/Enhancing -Oilfield-Operations-through-Wireless-Technology/, 4 pages (Feb. 2009).

(Continued)

*Primary Examiner* — Lewis West
(74) *Attorney, Agent, or Firm* — Myers Bigel Sibley & Sajovec, PA

(57) ABSTRACT

A method for communicating in liquid petroleum product includes providing a first communications device disposed in the liquid petroleum product, providing a second communications device remote from and separated from the first communications device by the liquid petroleum product, and transmitting radiofrequency (RF) communication signals embodying data between the first communications device and the second communications device through the liquid petroleum product to enable wireless communications between the first communications device and the second communications device.

22 Claims, 8 Drawing Sheets

U.S. PATENT DOCUMENTS

| | | | | |
|---|---|---|---|---|
| 2009/0143923 | A1* | 6/2009 | Breed | 701/1 |
| 2010/0194584 | A1* | 8/2010 | Savage | 340/853.1 |
| 2010/0307225 | A1* | 12/2010 | Yoshida | 73/40.5 A |
| 2010/0312601 | A1* | 12/2010 | Lin | 705/8 |
| 2011/0107812 | A1* | 5/2011 | Kasahara | 73/1.02 |

OTHER PUBLICATIONS

Wilt, "Exploring Oil Fields with Crosshole Electromagnetic Induction" https://www.llnl.gov/str/Wilt.html, 6 pages (Aug. 1996).

* cited by examiner

SYSTEMS AND METHODS FOR INSPECTION AND COMMUNICATION IN LIQUID PETROLEUM PRODUCT

RELATED APPLICATION(S)

This application claims the benefit of and priority from U.S. Provisional Patent Application No. 61/149,484, filed Feb. 3, 2009, the disclosure of which is incorporated herein by reference.

FIELD OF THE INVENTION

The present invention relates to communications and, more particularly, to communicating and inspecting in and through liquid petroleum product.

BACKGROUND OF THE INVENTION

Improvised explosive devices (IEDs) are used by terrorists around the world to kill people, destroy assets and disrupt economies. To date, IEDs have been used on land, but are seen increasingly as maritime threats. With numerous petroleum tankers calling at U.S. ports, it is evident that national and global economies depend heavily on the uninterrupted flow of liquid petroleum products.

Detonation of an IED on a loaded petroleum tanker, even a small coastal tanker carrying only a few thousand tons of a volatile refined product, while in port, could cause widespread destruction and loss of life. The economic impact of such an event may extend far beyond the harbor under attack, paralyzing national shipping for some time, with economic consequences that could travel round the world.

SUMMARY OF THE INVENTION

According to embodiments of the present invention, a method for communicating in liquid petroleum product includes: providing a first communications device disposed in the liquid petroleum product; providing a second communications device remote from and separated from the first communications device by the liquid petroleum product; and transmitting radiofrequency (RF) communication signals embodying data between the first communications device and the second communications device through the liquid petroleum product to enable wireless communications between the first communications device and the second communications device.

In some embodiments, the liquid petroleum product is a liquid petroleum fuel product.

According to some embodiments, the method includes transmitting the RF communication signals between the first communications device and the second communications device at a carrier frequency that is substantially non-coupling with respect to the liquid petroleum product.

According to some embodiments, the method includes transmitting the RF communication signals between the first communications device and the second communications device with a signal with a carrier frequency in the UHF band. In some cases, the RF communication signals include ultra wideband or Wi-Fi compatible type.

In some embodiments, the first communications device includes a sensor, and the method includes: sensing an environmental condition, an object, and/or emanation from an object using the sensor; and transmitting data representing the environmental condition, object or emanation from the first communications device to the second communications device through the liquid petroleum product.

In some embodiments, the first communications device includes an imaging device (e.g., a camera), and the method includes: capturing an image using the imaging device; and transmitting data representing the image from the first communications device to the second communications device through the liquid petroleum product.

According to some embodiments, the first communications device is an unmanned submersible vehicle, and the method includes transiting the unmanned submersible vehicle through the liquid petroleum product. The method may include autonomously navigating the unmanned submersible vehicle within the liquid petroleum product. In some embodiments, the second communications device is configured to emit radiofrequency (RF) control communication signals embodying commands to the unmanned submersible vehicle, the unmanned submersible vehicle is configured to receive and process the RF control communication signals from the second communications device, and the method includes transmitting the RF control communications signals from the second communications device to the unmanned submersible vehicle through the liquid petroleum product to enable remote wireless control of the unmanned submersible vehicle by the second communications device.

In some embodiments, the unmanned submersible vehicle and the liquid petroleum product are disposed in a container, and the method includes inspecting the container for explosive devices using the unmanned submersible vehicle. The container may be part of a moving liquid petroleum product container vehicle. The liquid petroleum product container vehicle can be a water-borne liquid petroleum product tanker.

The method may further include: providing a remote station remote from the liquid petroleum product container vehicle; and transmitting communication signals between the unmanned submersible vehicle and the remote station via a communications link through the second communications device. The method can include remotely controlling operation of the unmanned submersible vehicle using the remote station via the communications link through the second communications device. In some embodiments, the unmanned submersible vehicle includes a sensor, and the method includes transmitting data acquired by the sensor from the unmanned submersible vehicle to the remote station via the communications link through the second communications device. According to some embodiments, the communications link between the remote station and the second communications device is a satellite communications link.

In some embodiments, the method includes: providing a plurality of the unmanned submersible vehicles in the liquid petroleum product on the liquid petroleum product container vehicle and remote from the second communications device; and transmitting RF communication signals embodying data between the second communications device and each of the unmanned submersible vehicles through the liquid petroleum product to enable wireless communications between the unmanned submersible vehicles and the second communications device.

The method may include: providing a plurality of the unmanned submersible vehicles each on a respective one of a plurality of liquid petroleum product container vehicles; providing a plurality of second communications devices each associated with and located on the same liquid petroleum product container vehicle as a respective one of the unmanned submersible vehicles, wherein each of the unmanned submersible vehicles is separated from its associated second communications device by liquid petroleum product; providing a remote station remote from the plurality of liquid petroleum product container vehicles; transmitting RF communication signals between each of the unmanned submersible vehicles and the associated second communications devices through the liquid petroleum product to enable wireless communications between each unmanned submersible vehicle and its associated second communications device; and transmitting communication signals between each unmanned submersible vehicle and the remote station via a communication link through the unmanned submersible vehicle's associated second communications device.

According to embodiments of the present invention, a system for communicating in a liquid petroleum product includes first and second communications devices. The first communications device is disposed in a body of the liquid petroleum product and includes a first radio device. The second communications device is remote from and separated from the first communications device by the liquid petroleum product. The second communications device includes a second radio device. The system is configured to transmit radiofrequency (RF) communication signals embodying data between the first radio device and the second radio device through the liquid petroleum product to enable wireless communications between the first communications device and the second communications device.

According to embodiments of the present invention, an unmanned submersible vehicle for use in a liquid petroleum product with a remote receiver includes a hull, a propulsion device and a communications module. The hull is configured for submersion in a body of the liquid petroleum product. The propulsion device is configured to move the unmanned submersible vehicle through the body of liquid petroleum product. The communications module is configured to emit radiofrequency (RF) communication signals embodying at least one carrier frequency in the UHF band to enable wireless communications between the unmanned submersible vehicle and the remote receiver through the liquid petroleum product.

The unmanned submersible vehicle may include a sensor operable to detect an environmental condition and/or object, wherein the communications module is operable to transmit data representing the environmental condition, an object and/or an emanation from the object from the unmanned submersible vehicle to the remote receiver through the liquid petroleum product.

The unmanned submersible vehicle may include an imaging device operable to capture an image, wherein the communications module is operable to transmit data representing the image from the unmanned submersible vehicle to the remote receiver through the liquid petroleum product.

According to method embodiments of the present invention, a method for inspecting a container of a liquid petroleum product container vehicle, the container at least partly filled with liquid petroleum product, includes: providing a remote station remote from the liquid petroleum product container vehicle; providing an unmanned submersible vehicle in the container, the unmanned submersible vehicle including a sensor; and transmitting communication signals between the unmanned submersible vehicle and the remote station.

In some embodiments, the communication signals are transmitted from the unmanned submersible vehicle to the remote station and embody data representing signals from the sensor.

In some embodiments, the communication signals are transmitted from the remote station to the unmanned submersible vehicle and embody control signals to remotely control operation of the unmanned submersible vehicle.

According to some embodiments, the unmanned submersible vehicle is submerged in the liquid petroleum product during the step of transmitting communication signals between the unmanned submersible vehicle and the remote station.

The liquid petroleum product container vehicle may be a water-borne liquid petroleum product tanker.

According to further embodiments of the present invention, a system for inspecting a container of a liquid petroleum product container vehicle, the container at least partly filled with a liquid petroleum product, includes a remote station and an unmanned submersible vehicle. The remote station is remote from the liquid petroleum product container vehicle. The unmanned submersible vehicle is disposed in the container. The unmanned submersible vehicle includes a sensor. The system is configured to transmit communication signals between the unmanned submersible vehicle and the remote station.

According to embodiments of the present invention, a system for inspecting a container of a liquid petroleum product, the container at least partly filled with the liquid petroleum product, includes an imaging device and a receiver unit. The imaging device is positioned to capture images of the liquid petroleum product in the container and objects therein. The receiver unit is remote from the liquid petroleum product and the imaging device and is in communication with the imaging device. The imaging device is operative to transmit data representing the images to the receiver unit for analysis to determine the presence of a potential threat object in the liquid petroleum product.

In some embodiments, the imaging device is submerged in the liquid petroleum product.

In some embodiments, the system includes a water-borne liquid petroleum product tanker, and the container forms a part of the liquid petroleum product tanker.

Further features, advantages and details of the present invention will be appreciated by those of ordinary skill in the art from a reading of the figures and the detailed description of the embodiments that follow, such description being merely illustrative of the present invention.

DETAILED DESCRIPTION OF THE EMBODIMENTS OF THE INVENTION

Figure 1:
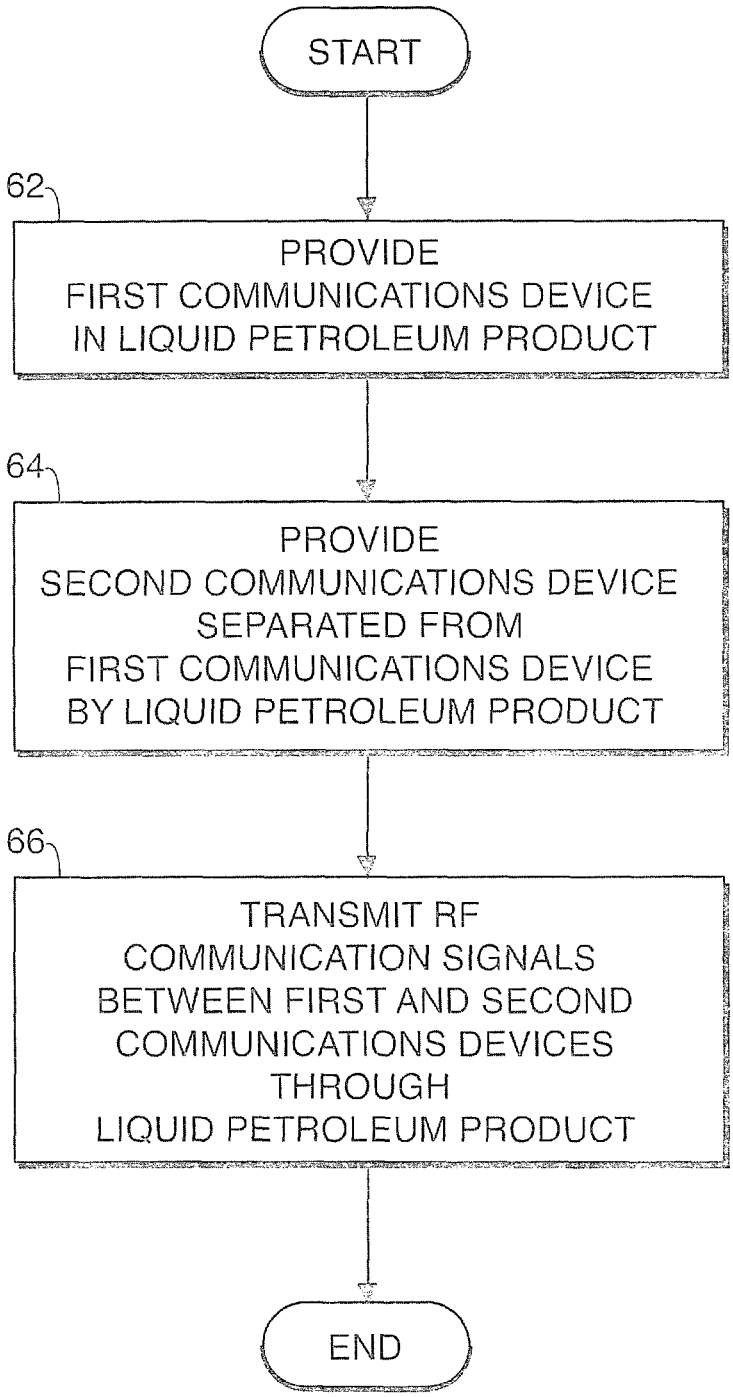
FIG. 1 is a flow chart representing methods according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, "submerged" means at least partly submerged.

"Non-coupling" means that the identified material does not substantially attenuate RF signals.

A "non-coupling fluid" means a fluid that does not attenuate a substantial amount of electromagnetic energy of a prescribed frequency. In some cases, such a fluid is substantially non-conductive and non-polar. According to some embodiments, the non-coupling fluid is a fluid that does not absorb or attenuate more than 1 dB per meter of an electromagnetic signal having a frequency in the ultra high frequency (UHF) band (i.e., from 300 MHz to 3 GHz). The non-coupling fluid may be a petroleum product such as crude oil or a liquid petroleum product derived therefrom.

As used herein, "liquid petroleum product" includes crude oil (petroleum) and liquid products derived from petroleum.

As used herein, "liquid petroleum fuel product" includes crude oil (petroleum) and combustible liquid fuel products derived from petroleum. Liquid fuel products derived from petroleum include gasoline (petrol), kerosene, jet fuel, distillate or residual diesel fuel, and distillate or residual fuel oil.

An "object" may include a foreign object or fluid volume (e.g., water collecting below a liquid petroleum product).

A "container vehicle" may be any vehicle including a container used to hold any liquid petroleum product. In some embodiments, the container vehicle is a water-borne vessel including a compartment for holding the liquid petroleum product. In some embodiments, the vessel is a tanker such as a sea-going oil tanker. While the term "tanker" is used hereinafter, it will be appreciated that in some embodiments, other types of container vehicles may be employed or inspected.

With IEDs on tankers a threat to ports and the economy, the current lack of inspection is a significant gap in our defense against terrorism. Submersible robotic vehicles are employed in other environments for various underwater missions, which may include missions that are dangerous, dirty or difficult, such as clearing sea mines or standing sentry against submerged incursion of our ports. Submersible robotic vehicles typically fall into two classes: the more complex unmanned undersea vehicles that navigate independently; and the less sophisticated remotely operated vehicles (ROV) which are controlled by an operator via a connecting cable. At present, submersible robotic vehicles lack the ability to self-navigate complex environments (such as the hull of a tanker) or to distinguish between ship components and an IED possibly hidden among them. While the cable on an ROV can carry data at high rates, it also commonly becomes hopelessly entangled when operating in a complex environment such as the product compartments in the hold of a tanker.

Thus, the foregoing types of submersible robotic vehicles are not well-suited for inspecting a liquid petroleum product-filled compartment or container. With detection of IEDs in loaded tanker compartments being a high priority for homeland defense, it is desirable to provide methods and apparatus for communicating with robotic vehicles submerged in a liquid petroleum product.

In light of the above, embodiments of the present invention provide wireless means of sending communications signals through a liquid petroleum product or other fluids to which electromagnetic signals (EMS) couple poorly (relative to an aqueous medium). In some embodiments, transmission of high bandwidth signals through such fluids is enabled. In some embodiments, apparatus and methods of the invention enable commanding, controlling or communicating with a device submerged in a liquid petroleum product. In some embodiments, apparatus and methods of the present invention are used to enable or include inspecting a liquid petroleum product tanker, searching for foreign objects, detecting for IEDs, conducting a maintenance inspection, and/or communicating through the liquid petroleum product. Methods according to embodiments of the present invention provide untethered communication at high bandwidth using a communications device submerged in a liquid petroleum product for internally inspecting liquid petroleum product-containing vessels such as oil tankers.

With reference to FIG. 1, methods of communicating in a liquid petroleum product in accordance with embodiments of the present invention are represented therein. A first communications device is placed in the liquid petroleum product (Block 62). A second communications device is provided remote from and separated from the first communications device by the liquid petroleum product (Block 64). Radiofrequency (RF) communication signals embodying data are transmitted between the first communications device and the second communications device through the liquid petroleum product to enable wireless communications between the first communications device and the second communications device (Block 66).

Figure 2:
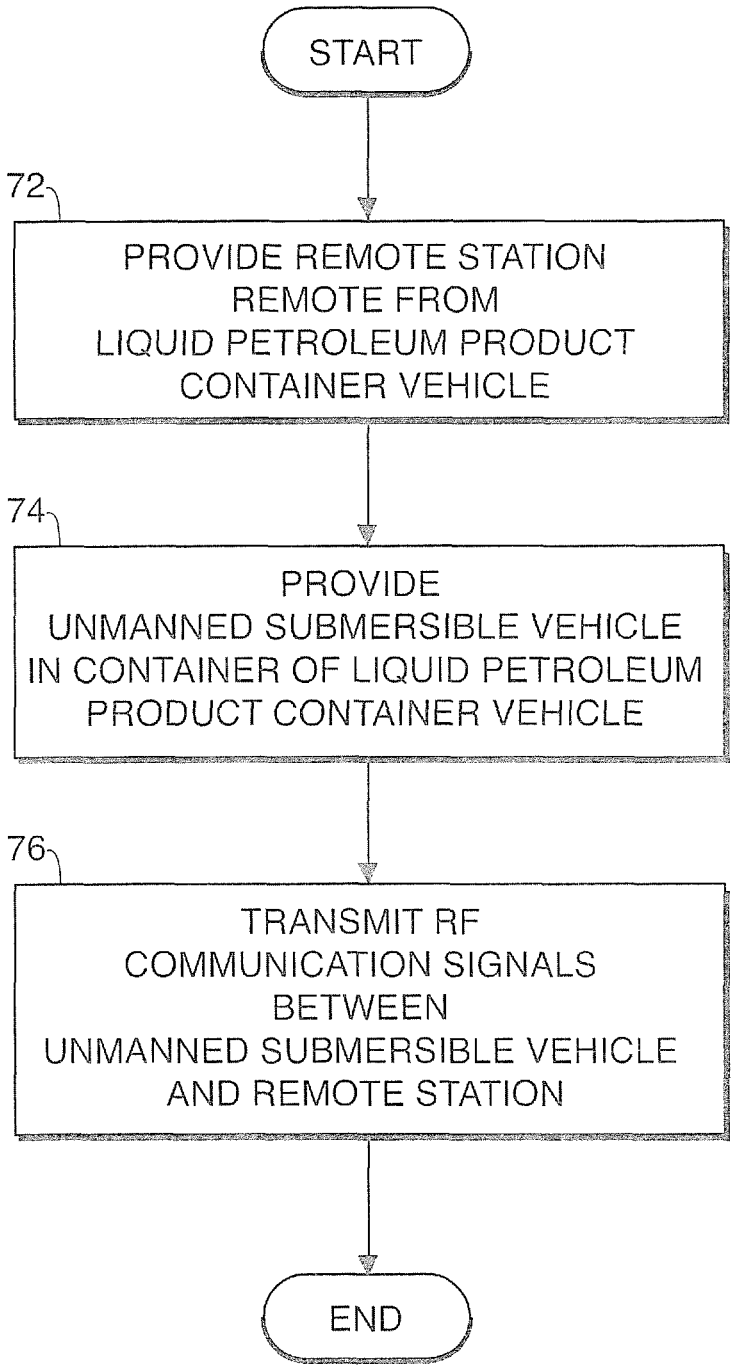
FIG. 2 is a flow chart representing further methods according to embodiments of the present invention.

With reference to FIG. 2, methods of communicating in a liquid petroleum product in accordance with embodiments of the present invention are represented therein. A remote station is provided remote from the liquid petroleum product container vehicle (Block 72). An unmanned submersible vehicle is provided in the container (Block 74). The unmanned submersible vehicle includes a sensor. Communication signals are transmitted between the unmanned submersible vehicle and the remote station (Block 76).

According to some embodiments of the present invention, systems and methods are provided for detecting adverse conditions or situations in a compartment of an liquid petroleum product container (in some embodiments, an liquid petroleum product containing vessel or vehicle such as a waterborne oil tanker) containing a liquid petroleum product. The adverse situations may include foreign objects, undesirable signals and/or compartment conditions. The system includes at least one sensor deployed in the liquid petroleum product, a receiving unit distal from the sensor such that the liquid petroleum product is interposed between the sensor and the receiving unit, and a communication device that enables communication between the sensor and the receiving unit. The system and method may employ aspects as described elsewhere herein.

In some embodiments, the system comprises an inspection object including the sensor. The inspection object may be permanently mounted in the compartment. In some embodiments, the inspection object may communicate with the receiving unit via a wired connection.

In other embodiments, the inspection object is removable (i.e., not permanently mounted in the compartment) and may be dropped into the compartment for inspection and subsequently removed from the compartment. The non-permanent inspection object may be a device (e.g., a USV) that is mobile within the liquid petroleum product and may be remotely controlled or self-navigating. The inspection object may include a battery. The inspection object may be responsive to a recall instruction to float to the top of the liquid petroleum product or otherwise terminate an inspection and travel to a recovery position to be recovered by an operator. In some embodiments, the removable inspection object may be tethered to the receiving unit or to another device (e.g., a local controller).

Figure 3:
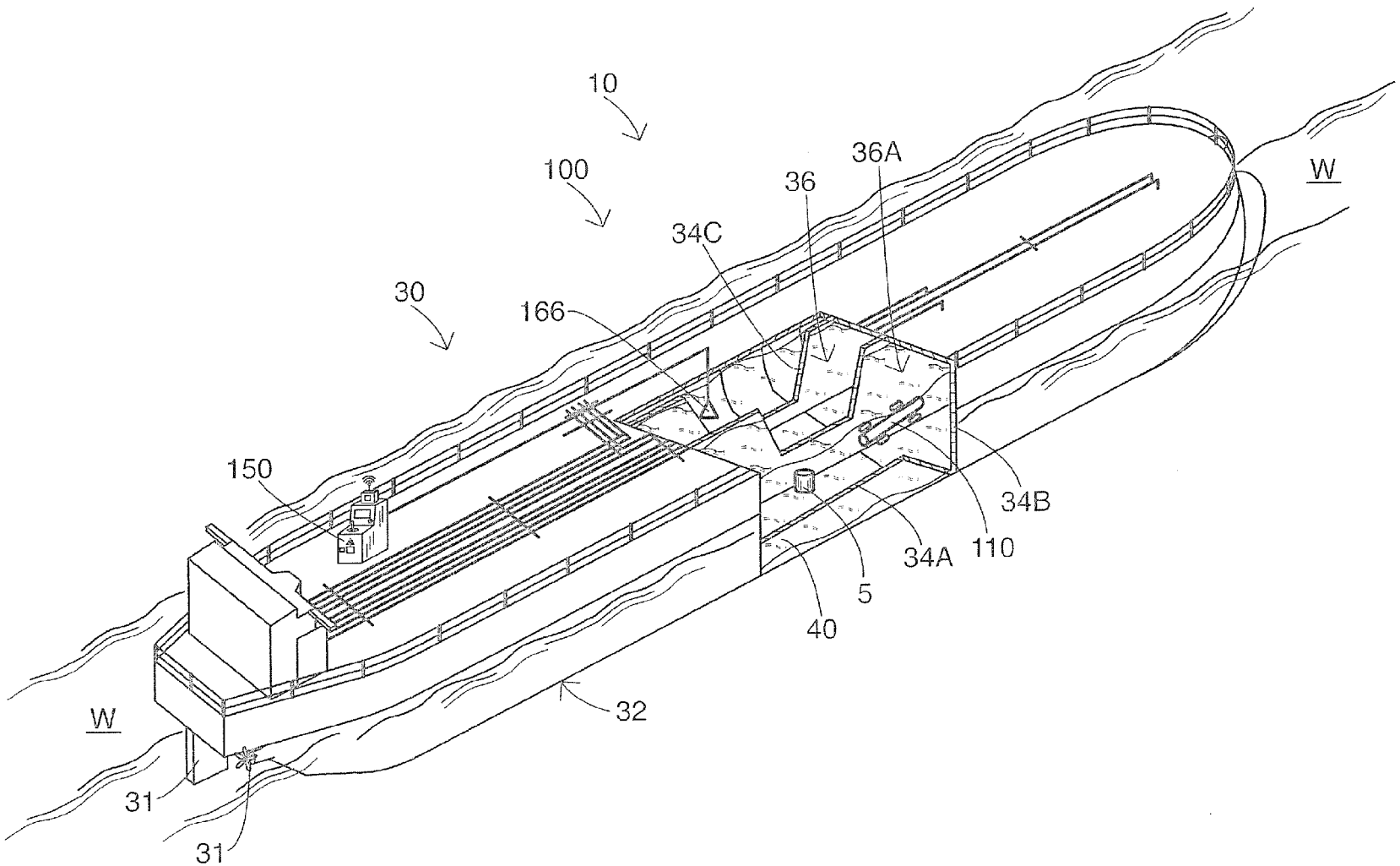
FIG. 3 is a schematic view of a liquid petroleum product transport system according to embodiments of the present invention and including an inspection and communications system according to embodiments of the present invention.

With reference to FIG. 3, a liquid petroleum product transport system 10 according to embodiments of the present invention is shown therein. The liquid petroleum product transport system 10 includes an oil or liquid petroleum product tanker 30 containing a cargo of liquid petroleum product 40, and an inspection and communications system 100 according to embodiments of the present invention. The tanker 30 floats on a body of water W such as an ocean or sea. In the illustrative example, a threat object 5 is disposed in the tanker 30. As discussed herein, the system 100 may be used to detect and report or otherwise address the presence of the threat object 5. The system 100 may be used to detect and report or otherwise address maintenance conditions of the tanker 30. In some cases, system 100 can survey and/or detect an object, signal or condition in the liquid petroleum product 40, such as water lying below the liquid petroleum product 40.

Turning to the tanker system 10 in more detail and with reference to FIG. 3, the tanker 30 includes a hull 32 and a liquid petroleum product container 34 mounted on or in or formed in part by the hull 32. The container 34 has a floor 34A and sidewalls 34B and defines a chamber 36 to hold the liquid petroleum product 40. The container 34 may have baffles or struts 34C segmenting the chamber 36 to define subchambers 36A that may or may not be in fluid communication. The chamber 36 is at least partly filled with the liquid petroleum product 40. The tanker 30 also includes propulsion and navigation mechanisms 31 to drive and controllably direct the water-borne tanker 30 to its intended destination. As discussed below, liquid petroleum product transport systems according to other embodiments of the invention may employ liquid petroleum product container vehicles other than waterborne liquid petroleum product tankers, which may transit on air, land or sea (e.g., liquid petroleum product container train cars or truck tankers).

The threat object 5 may be any device that poses a threat or may potentially pose a threat to the tanker 30 or its contents and which the system owner or operator regards as an object that should be reported for further investigation, response or remediation. For example, in some cases the threat object 5 is an improvised explosive device (IED) or other dangerous device.

Figure 6:
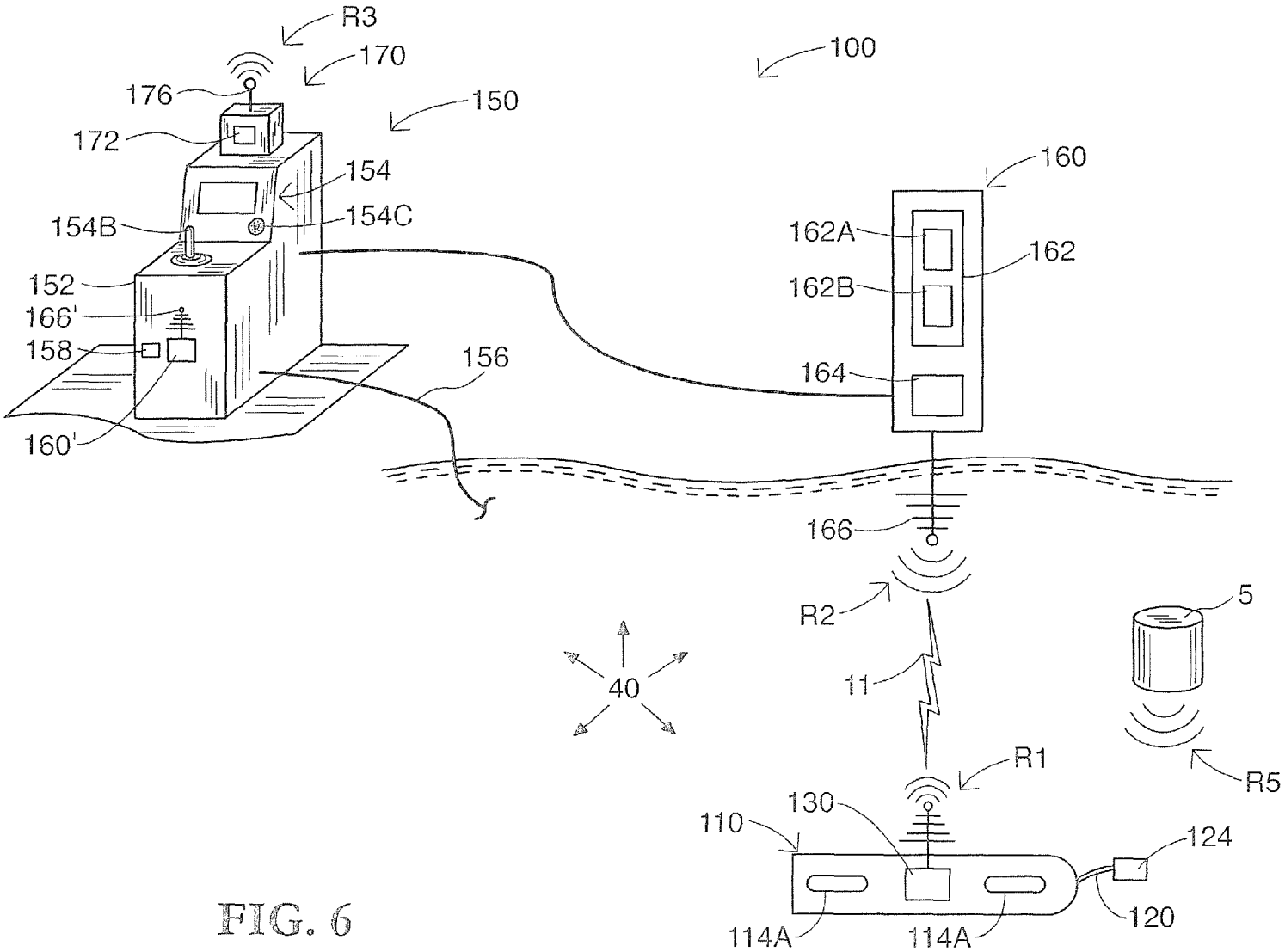
FIG. 6 is a schematic view of a local control station forming a part of the inspection and communications system of FIG. 3.

Referring to FIGS. 3 and 6, the system 100 includes a first communications device 110 and a second communications device 150, which are adapted to enable wireless communications therebetween via a wireless communications link L1 through the liquid petroleum product 40. The wireless communications can enable the first communications device 110 to send data to the second communications device 150 and/or enable the second communications device 150 to send commands to the first communications device 110 while the first communications device 110 remains untethered from the second communications device 150. According to some embodiments and as illustrated, the first communications device 110 is an unmanned submersible vehicle (USV) and the second communications device 150 is a local control station. The USV 110 is partially or fully disposed or submerged in the liquid petroleum product 40 in the container 34. The local control station 150 is mounted on the tanker 30 and separated from the USV 110 by the liquid petroleum product 40.

Figure 4:
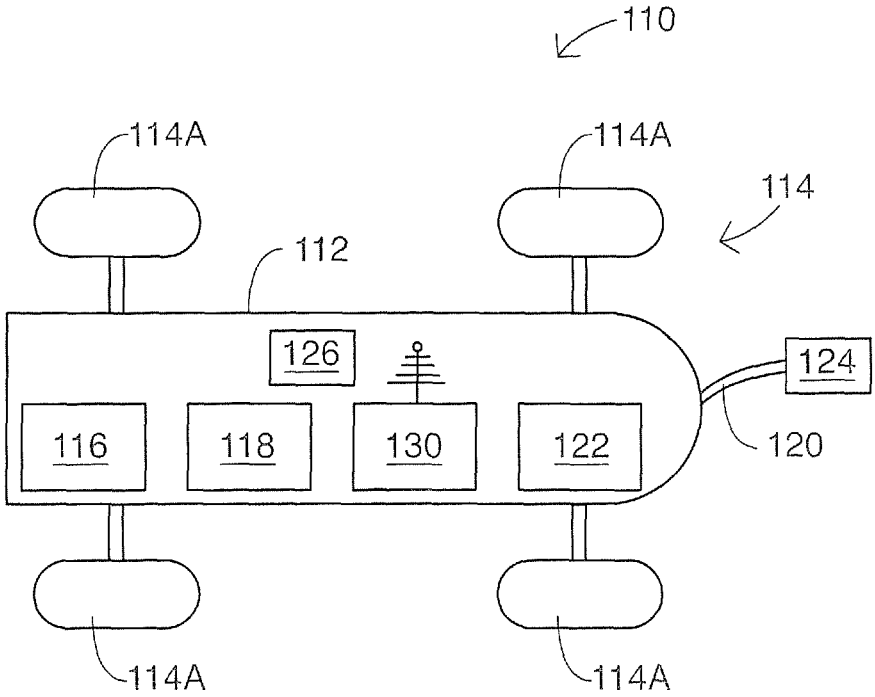
FIG. 4 is a schematic view of an unmanned submersible vehicle (USV) forming a part of the inspection and communications system of FIG. 3.
Figure 5:
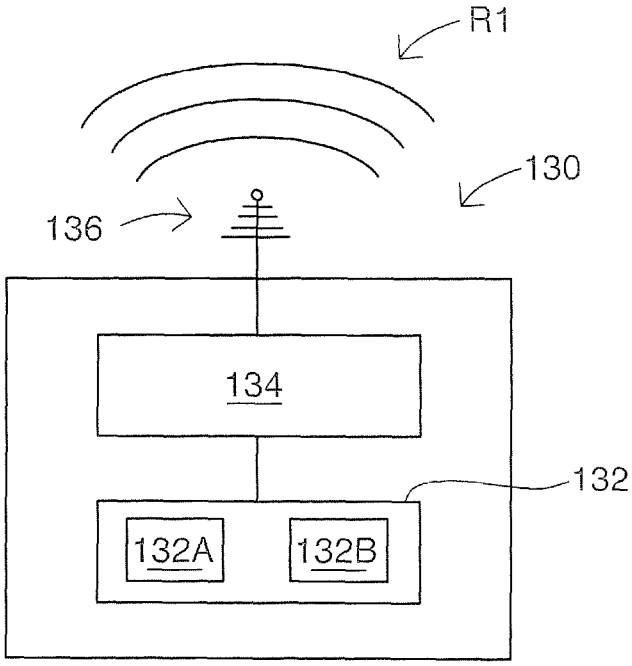
FIG. 5 is a schematic view of a communications module forming a part of the USV of FIG. 4.

With reference to FIGS. 4 and 5, the USV 110 includes a hull 112, a propulsion and navigation mechanism or system 114, an onboard power source 116, a ballast control system 118, a manipulator 120, sensors 122, 124, a controller 126, and a communications module 130. However, it will be appreciated that, in other embodiments, certain of these components may not be provided.

As shown, the propulsion and navigation system 114 includes a set of fins 114A that can be selectively driven to propel and/or steer the USV 110. Other devices may also be used, such as a wheel, track, rudder and/or propeller. Further mechanisms for providing propulsion and steering may include a traction force component, such as a magnet, weight, or suction provider that can provide a force to hold the USV 110 against the wall 34B or floor 34A.

The power source 116 can be any suitable type of device that can provide electrical energy. In some embodiments, the power source 116 is a battery.

The ballast control system 118 can be any suitable device that can provide a desired trim and/or buoyancy of the USV 110, such as neutral buoyancy in the liquid petroleum product 40. The ballast control system 118 may be any suitable type that can provide changeable buoyancy.

The manipulator 120 may be any suitable device that can manipulate, recover, sample, mark, localize, disturb, dislodge, or neutralize with respect to an object or a fluid. The manipulator 120 may be adapted to move or be moved with respect to the USV 110 and/or the threat object 5 in order to sense, sample and/or detect. In some cases, the manipulator 120 can perform at least one of the following with respect to the threat object 5: sample, retrieve, localize, mark and dislodge. In some cases, the manipulator 120 can carry a sensor 124 that can detect aspects of the threat object 5, the liquid petroleum product 40 or the tanker 30. As illustrated, one or more sensors 124 may be mounted on the manipulator 120 for improved or selectively variable positioning with respect to the hull 112.

The sensors 122, 124 may be any suitable sensors depending on the conditions or objects to be detected and assessed. According to some embodiments, at least one of the sensors 122, 124 provides an output that can be interpreted by an operator at the local control station 150. The sensors 122, 124 may detect a signal by passive or active means. In some embodiments, at least one of the sensors 122, 124 is an imaging device or sensor and, according to some embodiments, is an ultrasonic, radar, microwave, optical or thermal imaging sensor. However, other vector or scalar type sensors may be employed. According to some embodiments, the sensors 122, 124 include one or more of the following: an ultrasonic imaging sonar, a video camera, an X-ray camera, a radiation detector, a corrosion detector, an electrical detector, an acoustic detector, a vibration detector, a radar sensor, a magnetic sensor, an optical detector, a chemical detector, a microwave detector, a motion detector, a spectrophotometer, or a thermal detector.

With reference to FIG. 5, the communications module 130 includes a transceiver 132, an amplifier 134, and a transducer 136. The transceiver 132 includes a processor or controller 132A and suitable radio circuitry 132B. The communications module 130 is operative to generate radiofrequency (RF) data communication signals R1 (FIGS. 5 and 6) that are receivable through the liquid petroleum product 40 to form the communications link L1 (FIG. 6) in the direction from the USV 110 to the local control station 150. More particularly, the transceiver 132 generates RF data communication signals for transmitting, which are amplified by the amplifier 134 and transmitted via the transducer 136. The transducer 136 may be an RF antenna. The amplifier 134 may be an analog or digital amplifier. The controller 132A may be adapted to process or filter the RF communication signals, for example.

The transceiver 132 and the transducer 136 (or a further transceiver and/or transducer on the USV 110) are configured to receive and process RF communication signals R2 from the local control station 150 on the communications link L1, as discussed in more detail below.

According to some embodiments, the RF data communication signals R1 have at least one carrier or other signal component at a frequency in the UHF band on which data messages are embodied. In some embodiments, the signals R1 are of ultra wideband type. Lower frequency signals can be used for communications at low data rates for transfer of data such as small files and low resolution images.

According to some embodiments, the communications module 130 can be operated to send the RF data communication signals R1 at one or more other frequency (in some embodiments, in the UHF band) that is substantially non-coupling with respect to the liquid petroleum product 40, defined as exhibiting attenuation in the liquid petroleum product 40 of less than 6 dB per meter.

In some cases, the communications module 130 includes an ultra wideband, Wi-Fi and/or multi-input/multi-output (MIMO) device of any type. The communications module 130 may include a device or devices that can provide signal modulation or demodulation of any type, such as frequency modulation, amplitude modulation, spectrum spreading, filtering, orthogonal coding, pseudo random coding, code dividing, or frequency hopping.

With reference to FIG. 6, the local control station 150 as illustrated includes a housing or cabinet 152, an operator interface 154, a communications cable 156, a controller 158, a communications module 160, a further communications module 160', and a secondary or forwarding communications module 170. The local control station 150 can be mounted in any suitable location in or on the tanker 30. The local control station 150 can be provided in a substantially modular or localized configuration or components and functionality thereof may be distributed about the tanker 30.

The operator interface 154 may include a display screen 154A, a user input device or devices 154B (e.g., a joystick, mouse, keyboard or the like), and an audio transducer 154C.

The communications module 160 includes a transceiver 162, an amplifier 164, and a transducer 166. The transceiver 162 includes a processor or controller 162A and suitable radio circuitry 162B. The transducer 166 may be a radiofrequency antenna at least partially submerged in the liquid petroleum product 40.

The transceiver 162 and the transducer 166 are configured to receive and process the RF communication signals R1 from the USV 110 on the communications link Ll. The received signals are provided to the controller 158 for interpretation and/or handling.

The communications module 130 is also operative to generate radiofrequency (RF) control communication signals R2 that are receivable through the liquid petroleum product 40 to form the communications link L1 in the direction from the local control station 150 to the USV 110. More particularly, the transceiver 162 generates RF control communication signals for transmitting, which are amplified by the amplifier 164 and transmitted via the transducer 166. The transducer 162 may be an RF antenna. The amplifier 164 may be an analog or digital amplifier. The controller 162A may be adapted to process or filter the RF communication signals, for example.

According to some embodiments, the RF control communication signals R2 have at least one carrier or other signal component at a frequency in the UHF band on which control messages are embodied. According to some embodiments, the RF control communication signals R2 are of the same type as the RF data communication signals R1, but this is not required. Lower frequency signals can be used for communications at low data rates for transfer of data such as control instructions.

According to some embodiments, the communications module 160 can be operated to send the RF control communication signals R2 at one or more other frequency (in some embodiments, in the UHF band) that is substantially non-coupling with respect to the liquid petroleum product 40, defined as exhibiting attenuation in the liquid petroleum product 40 of less than 6 dB per meter. In some cases, the communications module 160 includes an ultra wideband, Wi-Fi and/or MIMO type communication device.

The communications module 160' can be constructed and operated in the same manner as the communications module 160, except that the transducer 166' of the communications module 160' need not be submerged in the liquid petroleum product 40, but is instead disposed in the air (e.g., an air-operative aerial). The transducer 166' is provided to detect RF data communication signals R1 propagating in air, such as from the surface of the liquid petroleum product 40.

The secondary communication module 170 includes a transceiver 172 and a transducer 176. The secondary communication module 170 may be configured to serve as a forwarding radio and wirelessly communicate with a further station (e.g., the remote control station 180 discussed below) via a communication link or links (e.g., the communication link or links L2, L3, L4 through the satellite 50).

The communications cable 156 may be an electrical or optical cable, for example. The communications cable may provide a wired linkage to an operator remote from the local control station 150.

The controller 158 of the local control station 150 may include suitable software or firmware capable of programmatically evaluating the data provided to the local control station via the RF data communication signals R1. The controller 158 may be programmed to issue an alarm, classification and/or identification of the threat object 5, the tanker 30, the liquid petroleum product or a signal detected therein.

With reference to FIGS. 1 and 6, illustrative uses of the system 100 will now be described. The system 100 is used to inspect the tanker 30 to detect the foreign or threat object 5 (such as an IED), a foreign signal R5 (e.g., a signal emanating from the threat object 5), or a maintenance condition such as breakage, leakage, wear, or corrosion of a ship component such as the container wall 34B or floor 34A. More particularly, the USV 110 travels within and through the liquid petroleum product 40 to survey the ship components and/or liquid volume of the liquid petroleum product 40 with the sensors 122, 124.

The controller 126, using the transceiver 132, sends wireless RF communication signals R1 embodying a data message or information acquired from the sensors 122, 124 to the local control station 150. The data message or information embodied on the signals R1 may be reflective of a foreign object, signal or condition with respect to the tanker 30 or one of its components or spaces. The local control station 150 receives the RF communication signals R1, via the transceiver 162, extracts the data message or information from the signal R1, and processes, forwards, and/or reports (e.g., displays) the information. The controller 158 may, using the transceiver 162, send wireless RE control communication signals R2 embodying command messages to the USV 110 to control operation of the USV 110. The USV 110, using the transceiver 132, receives and processes the RF control communication signals R2. In this manner, the system 110 can provide untethered communication from the USV 110 to the local control station 150 and/or untethered, active (e.g., real-time) control of the USV 110 by the local control station 150. The system 100 can be used to survey, inspect, command, control, detect, classify, identify, alarm, data request, localize, manipulate, sample, disturb and/or neutralize with respect to signals, objects or conditions in the volume of the liquid petroleum product 40.

In an illustrative use of the system 100, an operator deploys the USV 110 in a tanker compartment 38A at least partly filled with liquid petroleum product 40, and maneuvers the USV 110 in and among the compartments 38A while inspecting or searching for a foreign object (e.g., the threat object 5), an unexpected signal, or a maintenance condition using one or more of the sensors 122, 124. The search can include long range or close range sensing or inspecting, and partial or complete inspection. In some embodiments, the search is conducted with ultrasonic imaging sonar, although an optical camera is acceptable if the liquid petroleum product 40 is reasonably transparent at at least one wavelength of interest.

An object, signal or condition can be detected in the tanker 30 by active or passive sensors 122, 124. As discussed above, the sensors 122, 124 may be operative to detect acoustic, ultrasonic, microwave, X-ray, sonar, optical, magnetic, thermal, vibration, chemical, radiologic or electrical signals within the liquid petroleum product 40. Detection can include detecting a constituent of the object 5, such as a chemical of an explosive material. Detection can include forming an image representative of the object 5. Image forming is defined as creating any visually interpretable representation of at least a part of an object, signal or condition. Examples include sonar image, ultrasound image, optical picture, computer graphic, animation, video, time domain plot, and frequency domain spectrum of a signal, as well as a set of coefficients or data points that can be formed into a visually interpretable presentation.

In some cases, the USV 110 monitors for unexpected signals, such as gamma rays, that can indicate the presence of a radioactive source, independent of foreign object detection. According to some embodiments, the sensor 160 is a radiation detector and the method includes transiting the USV 110 through the chamber 36 to detect radioactive material, which may include radioactive nuclear material incorporated into an IED.

The data from the sensors 122, 124 is provided or fed to the local control station 150 via the RF data communication signals R1 as discussed above, where the data may be displayed, interpreted, forwarded, and/or analyzed by an operator at the local control station 150 or programmatically (e.g., by the controller 158). The data may also be programmatically processed, analyzed, or compiled by the controller 126 of the USV 110. Other data may also be communicated to the local control station 150 on the RF data communication signals R1, such as update information, information indicating the location of the USV 110, and information indicating a state or status of the USV 110.

The received signals R1 may be displayed in any form by the operator interface 154 for review, interpretation or classification by the operator (e.g., classifying an object as a ship component, lost tool, uncertain or IED). The operator can act based on the review, passing over ship components and lost tools, inspecting uncertain objects more, and issuing an alarm regarding an IED, for example.

In some embodiments, a human operator reviews a display of the data on the display 154A to determine if such a foreign object, undesirable signal and/or maintenance condition of interest is present in the compartment (e.g., the human operator may classify the object, signal or condition). In some embodiments, the data is an image from the sensor 124 and the human operator determines whether an object depicted in the image is an IED or other threatening object. The human operator may be a person trained to have special expertise in identifying or classifying such objects or other threats. Additionally or alternatively, the image or other data may be evaluated programmatically (e.g., by suitable software such as image pattern recognition software). For example, the controller 158 may programmatically identify a potential threat or may enhance the image to facilitate review by the human operator.

In response to detecting or sensing, an object, signal or condition can be classified, identified or characterized. Classifying includes at least provisionally assigning an object (such as by operator visual inspection, or by automated pattern recognition, signal interpretation, data interpretation, or constituent detection) to one or more class (such as normal ship component, foreign object, or maintenance condition). Classifying can include assigning a detected object to the class of foreign object. Further classification can be conducted based on detection of a signal or constituent. One example is to classify a foreign object 5 as an IED if radiation or a nitrogenous chemical is detected. Identification can be conducted based on the detected signal or chemical. For example, a gamma ray spectrum can be used to identify the type of a radiation source as weapons grade or low level material.

The information provided to the local control station can be used to characterize a maintenance condition. For example, a maintenance condition can be characterized or classified based on a time domain plot of wall thickness resulting from a survey of a compartment with a maintenance sensor such as an ultrasonic plate thickness probe.

In some embodiments, an alarm or alarms are communicated based on various criteria for results of detection, classifying, identifying or characterizing. For example, the USV 110, the local control station 150 or the operator (e.g., using the local control station 150), can issue an alarm if a foreign object is visualized, or the USV 110, local control station 150 or operator can issue an alarm in response to detecting a radiation signal or a maintenance condition such as a thin spot in a wall. In some cases, an alarm is issued on detection of a signal or constituent without detection of an object. For example, an alarm can be issued on detection of gamma ray energy above a background level, detection of a constituent of a manufactured explosive material, or detection of a thermal or electrical signal that could ignite liquid petroleum product or permit a leak.

As discussed above, the USV 110 can transit through the liquid petroleum product 40 in order to inspect different locations within the chamber 36. In some cases, the USV 110 is fully or partially self-navigating. For example, the USV 110 may follow a preprogrammed or random path. In some embodiments, the USV 110 is navigated by a remote controlled such as the local control station 150, as discussed in more detail below.

As discussed above, the local control station 150 can send various RF control communication signals R2 to the USV 110 submerged in the liquid petroleum product 40. The RF control communication signals R2 embody messages that the USV 110 interprets and responds to. The messages transmitted to the USV 110 in this manner may include command, control or request instructions to induce operations of the USV 110. The command, control or request instructions and messages may be initiated by the operator of the local control station 150. For example, the human operator can remotely control actuation of and execution of tasks or operations by various components and functions of the USV 110. Additionally or alternatively, at least some of the instructions and messages may be initiated by the controller 158 programmatically. In some embodiments, the system 100 operates in a semi-autonomous mode wherein the USV 110 is provided episodic guidance with respect to navigation and/or sensing from the local controller station.

In some embodiments, the operator, using the local control station 150, sends the USV 110 RF control communication signals R2 that direct the navigation of the USV 110 in the liquid petroleum product 40.

In some embodiments, the RF control communication signals R2 poll the USV 110 for data reports.

In some embodiments, the RF control communication signals R2 instruct the USV 110 to activate or use a sensor 122, 124.

In some embodiments, the RF control communication signals R2 instruct the USV 110 to operate the manipulator 120. For example, the RF control communication signals R2 may instruct the USV 110 to position or point the sensor 124 with respect to a threat object 5.

In some embodiments, the RF control communication signals R2 instruct the USV 110 to send data to the local control station 150 indirectly related to the inspection or found object or signal, such as the location, orientation, temperature, or remaining battery capacity of the USV 110.

In some embodiments, the RF control communication signals R2 instruct the USV 110 to recover, sample, mark, dislodge or neutralize an object 5. For example, the RF control communication signals R2 may instruct the USV 110 to move the manipulator 120 in a desired manner.

In some embodiments, the transmitted RF communication signals R1 are captured by the communication module 160 via the transducer 166 at least partly submerged in the liquid petroleum product 40. In some cases, the transmitted RF communication signals R1 are captured by the communication module 160' via the transducer 166', which is positioned to detect in-air electromagnetic signals emanating from the liquid petroleum product 40.

Figure 7:
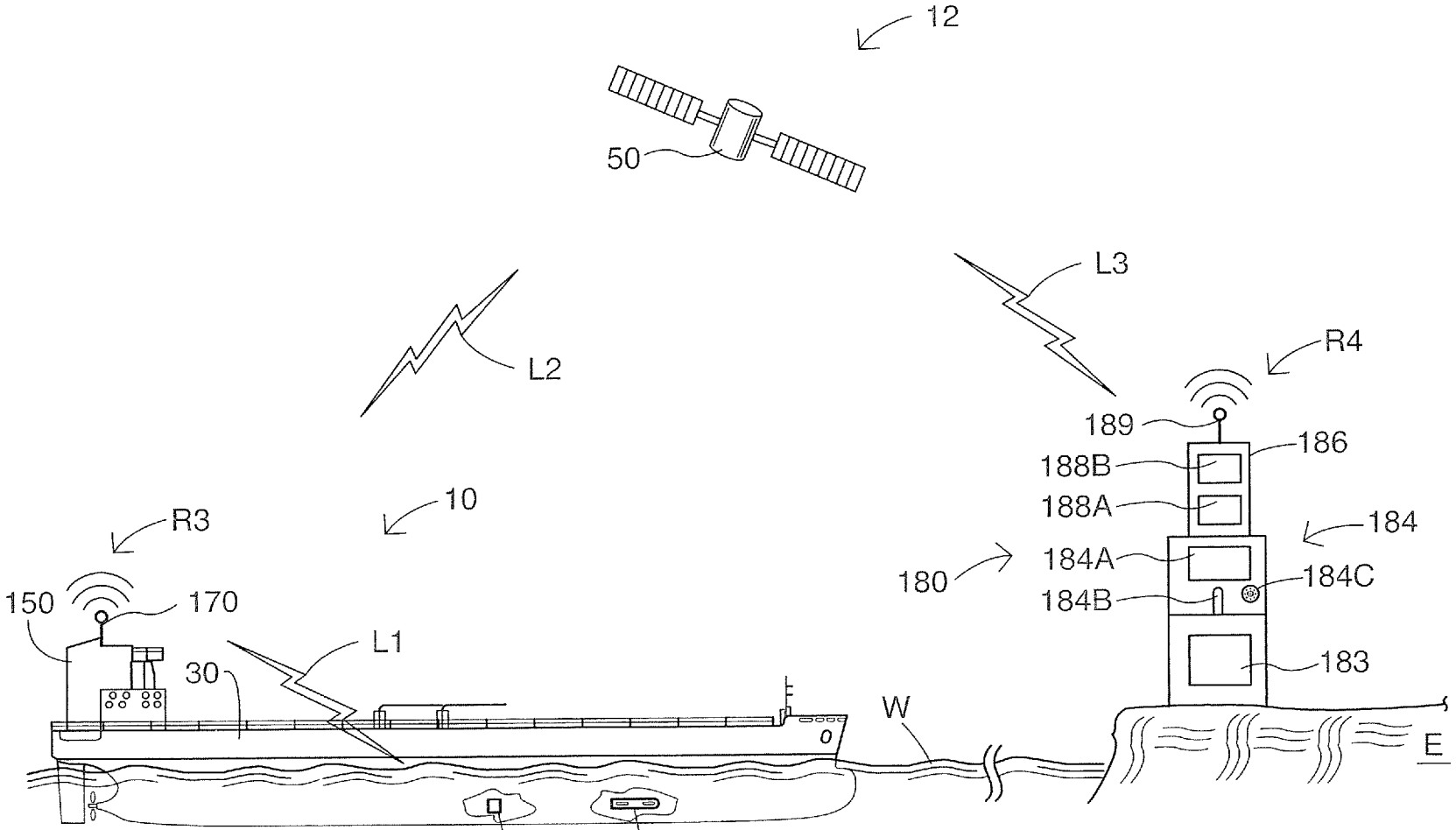
FIG. 7 is a schematic view of a liquid petroleum product transport system according to further embodiments of the present invention.

With reference to FIG. 7, a tanker system 12 according to further embodiments of the present invention is shown therein. The tanker system 12 includes the tanker system 10 as described hereinabove. The system 12 further includes a remote control station 180, which is located some distance from the water-borne tanker 30 and may be located on land E. The system 12 may further include a relay device or network such as a satellite 50. The remote control station 180 includes a controller 183, an operator interface 184 and a communications device or module 186.

The operator interface 184 may include a display screen 184A, a user input device or devices 184B (e.g., a joystick, mouse, keyboard or the like), and an audio transducer 184C.

The communications module 186 includes a transceiver 188 and a transducer 189. The transceiver 188 includes a processor or controller 188A and suitable radio circuitry 188B. The transducer 189 may be radiofrequency antenna positioned to receive signals in air. The transducer 189 may be located remote from remainder of the remote control station 180.

The transceiver 188 and the transducer 189 are configured to receive and process the RF communication signals R3 (FIG. 6) from the communications module 170 of the local control station 150 on the communications links L2 and L3. The received signals are provided to the controller 183 for interpretation and/or handling.

The communications module 186 is also operative to generate radiofrequency (RF) control communication signals R4 that are sent via the satellite 50 on the communications links L2 and L3 from the remote control station 180 to the local control station 150. The controller 188A may be adapted to process or filter the RF communication signals, for example.

According to some embodiments, the RF control communication signals R4 from the remote control station 180 can communicate or otherwise provide data (such as classification, identification, spectra or images) at a rate in the range of from about 5 Baud (Bd) to 50 MBaud (MBd).

In use, the local control station 150 forwards or relays signals (processed or unprocessed) or data therefrom from the USV 110 to the remote control station 180. The signals or data may be forwarded to the remote control station 180 via the communication links through the satellite 50, for example. Likewise, the local control station 150 can forward or relay command signals (processed or unprocessed) or data from the remote control station 180 to the USV 110.

Certain components of the local control station 150 can be provided in the remote control station 180 instead of or in addition to being provided in the local control station 150. For example, as discussed above, the remote control station 180 can include an operator interface 184 so that a remote operator can monitor and control the USV 110 as discussed above with respect to the local control station 150. By way of example, in some embodiments, the local control station 150 merely relays the signals between the remote control station 180 and the USV 110 without processing and/or without displaying.

In some embodiments, a human operator reviews a display of the data on the display 184A to determine if a foreign object, undesirable signal and/or maintenance condition of interest is present in the compartment 36 (e.g., the human operator may classify the object, signal or condition). In some embodiments, the data is an image from the sensor 124 and the human operator determines whether an object depicted in the image is an IED or other threatening object. The human operator may be a person trained to have special expertise in identifying or classifying such objects or other threats. Additionally or alternatively, the image or other data may be evaluated programmatically (e.g., by suitable software such as image pattern recognition software). For example, the controller 183 may programmatically identify a potential threat or may enhance the image to facilitate review by the human operator. This method and the system 12 can be advantageous in that the human operator and/or equipment can be located in a more secure, convenient or cost-effective location than in the vessel being inspected (e.g., on land E).

According to some embodiments of the present invention, a system as described herein employs a plurality of communications devices (e.g., USVs 110) submerged in liquid petroleum product that each communicate (directly or indirectly) with the same receiving unit (i.e., a shared receiving unit), thereby enabling centralized control of the inspection objects and/or centralized processing of the data sent from the communications devices. In some embodiments, the shared receiving unit is a remote receiving station as discussed above that is remote from the inspection object and the vessel having the compartment. In this manner, the data from the multiple communications devices can be reviewed and analyzed by the same human operator or processing equipment.

Figure 8:
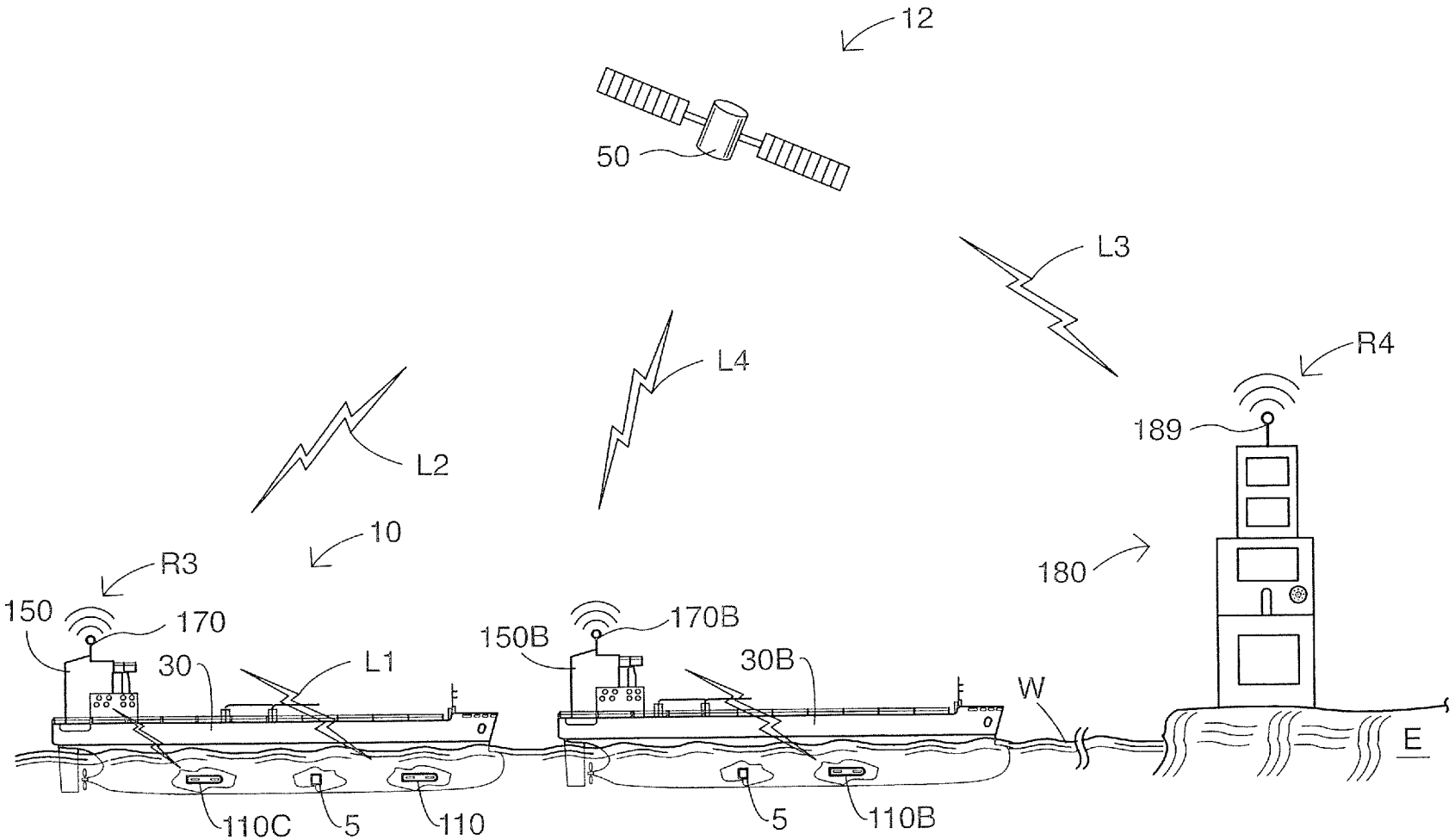
FIG. 8 is a schematic view of a liquid petroleum product transport system according to further embodiments of the present invention.

For example, as illustrated in FIG. 8, the remote control station 180 communicates with a plurality of local control stations 150, 150B via their respective forwarding communication modules 170, 170B. The local control stations 150, 150B may be located on different tankers 30, 30B and relay signals between the remote control station 180 and respective USVs 110, 110B located on the different tankers 30, 30A via respective communication links L2 and L4.

In some embodiments, and as illustrated in FIG. 8, a given local control station 150 communicates with two or more USVs 110, 110C on the same tanker 30 via their respective communication modules 130. Thus, in the case of a networked remote control station 180, the given local control station 150 can relay signals between the remote control station 180 and multiple local USVs 110, 110C which share the local control station 150.

The use of a remote control station 180 networked to communicate with one or more USVs 110, 110B, 110C can enable centralized control, reduce labor cost, and/or leverage expertise in operation of the USVs and/or threat image recognition. Such a system and method can provide efficient and secure implementation of skilled personnel and sensitive equipment. The use of multiple USVs 110, 110C on the same tanker 30 can speed the rate of inspection. The use of a single local control station 150 to serve multiple USVs 110, 110B, 110C may enable group control, enable centralized control, and reduce equipment requirements.

According to some embodiments, one or more of the systems and/or methods as described herein are provided as a vendor service. A vessel operator or other interested party (hereafter, "customer") of a vessel containing liquid petroleum product in a compartment thereof may wish to monitor or inspect the compartment to identify the presence of any potential foreign objects, undesirable signals or compartment conditions of interest. One or more inspection objects or units (e.g., the USVs 110, 110B, 110C) as described herein are mounted or temporarily placed in the compartment or compartments of the vessel at least partially filled with the liquid petroleum product, and a receiving unit (e.g., the local control station 150) as described herein is also mounted in the vessel. More than one receiving unit may be employed on the vessel. The customer hires the vendor to review and evaluate data from the inspection object(s). The vendor utilizes a remote receiving station (e.g., the remote control station 180) as described herein and to which the receiving unit on the vessel forwards the data from the sensors (e.g., the sensors 122, 124) of the inspection units to the remote receiving station where the data is reviewed and analyzed (and, in some cases, classified) by a human operator and/or programmatically. The vendor service may further include issuing a report or alarm to the customer in the event the operator or vendor processing equipment identifies an object, signal or condition of concern from the data. In some embodiments, a given remote receiving station receives and evaluates data from inspection units located on a plurality of such vessels, which may be associated with different customers. In some embodiments, the vendor (e.g., the human operator) also controls the operation of the inspection units remotely from the remote receiving station via the receiving unit. For example, a human operator at the remote control station 180 may navigate and otherwise control operation of one or more of the USVs 110, 110B, 110C as discussed above with regard to control of the USV 110 using the local control station 150 in the system 10 (FIG. 1).

While the tanker systems 10, 12 are described in terms of USVs 110, 110B, 110C and liquid petroleum product tankers 30, 30B, it will be appreciated that methods and systems as disclosed herein may be employed with other types of liquid petroleum product-containing vessels or vehicles such as liquid petroleum product-containing (e.g., oil containing) tanker train cars or tanker trucks.

According to some embodiments, the data transmission rate of RF data communication signals R1 to the local control station 150 is at least 1 kBd (1000 bits per second) and, according to some embodiments, in the range of from 1 kBd to 10 MBd. According to some embodiments, the data transmission rate of the RF control communication signals R2 from the local control station 150 to the USV 110 is at least 5 Bd and, according to some embodiments, from 100 Bd to 1 kBd.

According to some embodiments, the liquid petroleum product vessel (e.g., the tanker 30) is a Handymax class tanker (having a liquid petroleum product carrying capacity of about 30,000 to 50,000 DWT) or a Panamax class tanker (having a liquid petroleum product carrying capacity of about 50,000 to 80,000 DWT).

Figure 9:
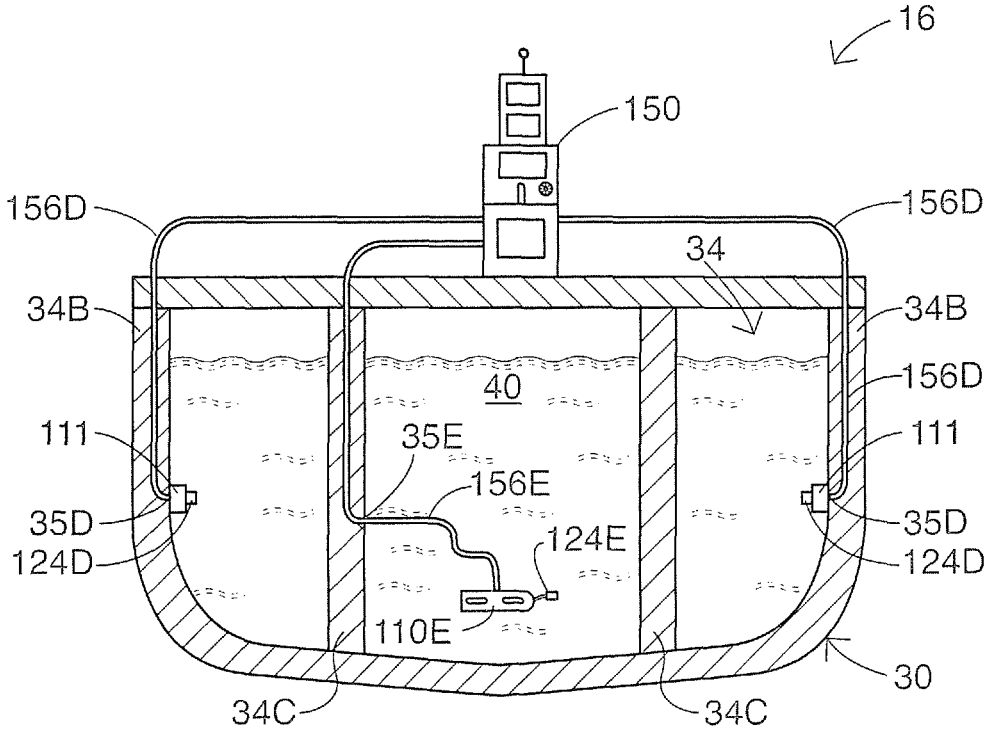
FIG. 9 is a schematic view of a liquid petroleum product transport system according to further embodiments of the present invention.

With reference to FIG. 9, a schematic, cross-sectional view of a liquid petroleum product transport system 16 according to further embodiments is shown therein. The system 16 includes a tanker 30 as described herein with reference to FIG. 3. Sensors in the form of imaging 124D are mounted on the walls 34B, floor 34A and/or baffles 34C, for example, of the tanker 30 in order to acquire images of the volume of the oil 40. The imaging devices 124D may be submerged in the oil 40. The imaging devices 124D may form a part of a communications device 111 including additional components (e.g., mechanisms or electrical circuits) for positioning or activating the imaging device 124D or processing the signals therefrom.

The imaging devices 124D may be operatively connected (i.e., hardwired) to access points 35D by communications cables 156D or a wireless interface, for example, to enable communications of data representing the images from the imaging devices 124D to the local control station 150. The image data may be utilized in the same manner as described above.

The system 16 as illustrated further includes a USV 110E submerged in the oil 40. The USV 110E has an imaging device 124E and may correspond to the USV 110 except that the USV 110E is tethered to an access point 35E in the product container 34 by a communications cable 156E for communicating image data to the local control station 150. The local control station 150 may in turn provide control signals to the imaging devices 124D, 124E or the USV 110E via the communications cables 156D, 156E.

The imaging devices 124D, 124E may be ultrasonic, radar, microwave, optical or thermal imaging sensors, for example.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed:

1. A method for communicating in a liquid petroleum product, the method comprising:

providing a first communications device disposed in the liquid petroleum product;

providing a second communications device remote from and separated from the first communications device by the liquid petroleum product; and transmitting radiofrequency (RF) communication signals embodying data between the first communications device and the second communications device through the liquid petroleum product to enable wireless communications between the first communications device and the second communications device;

wherein:

the first communications device is an unmanned submersible vehicle, and the method includes transiting the unmanned submersible vehicle through the liquid petroleum product;

the second communications device is configured to emit radiofrequency (RF) control communication signals embodying commands to the unmanned submersible vehicle;

the unmanned submersible vehicle is configured to receive and process the RF control communication signals from the second communications device; and the method includes transmitting the RF control communications signals from the second communications device to the unmanned submersible vehicle through the liquid petroleum product to enable remote wireless control of the unmanned submersible vehicle by the second communications device.

2. The method of claim 1 wherein the liquid petroleum product is a liquid petroleum fuel product.

3. The method of claim 1 including transmitting the RF communication signals between the first communications device and the second communications device at a carrier frequency that is substantially non-coupling with respect to the liquid petroleum product.

4. The method of claim 1 including transmitting the RF communication signals between the first communications device and the second communications device with a signal with a carrier frequency in the UHF band.

5. The method of claim 1 wherein the first communications device includes a sensor, and the method includes:

sensing an environmental condition, an object, and/or an emanation from the object using the sensor; and transmitting data representing the environmental condition, object and/or emanation from the first communications device to the second communications device through the liquid petroleum product.

6. The method of claim 1 wherein first communications device includes an imaging device, and the method includes:

capturing an image using the imaging device; and transmitting data representing the image from the first communications device to the second communications device through the liquid petroleum product.

7. The method of claim 1 including autonomously navigating the unmanned submersible vehicle within the liquid petroleum product.

8. A method for communicating in a liquid petroleum product, the method comprising:

providing a first communications device disposed in the liquid petroleum product;

providing a second communications device remote from and separated from the first communications device by the liquid petroleum product; and transmitting radiofrequency (RF) communication signals embodying data between the first communications device and the second communications device through the liquid petroleum product to enable wireless communications between the first communications device and the second communications device;

wherein:

the first communications device is an unmanned submersible vehicle, and the method includes transiting the unmanned submersible vehicle through the liquid petroleum product;

the unmanned submersible vehicle and the liquid petroleum product are disposed in a container; and the method includes inspecting the container for explosive devices using the unmanned submersible vehicle.

9. The method of claim 8 wherein the container is part of a moving liquid petroleum product container vehicle.

10. The method of claim 9 wherein the liquid petroleum product container vehicle is a water-borne liquid petroleum product tanker.

11. The method of claim 9 further including:

providing a remote station remote from the liquid petroleum product container vehicle; and transmitting communication signals between the unmanned submersible vehicle and the remote station via a communications link through the second communications device.

12. The method of claim 11 including remotely controlling operation of the unmanned submersible vehicle using the remote station via the communications link through the second communications device.

13. The method of claim 11 wherein the unmanned submersible vehicle includes a sensor, and the method includes transmitting data acquired by the sensor from the unmanned submersible vehicle to the remote station via the communications link through the second communications device.

14. The method of claim 11 wherein the communications link between the remote station and the second communications device is a satellite communications link.

15. The method of claim 9 including:

providing a plurality of the unmanned submersible vehicles in the liquid petroleum product on the liquid petroleum product container vehicle and remote from the second communications device; and transmitting RF communication signals embodying data between the second communications device and each of the unmanned submersible vehicles through the liquid petroleum product to enable wireless communications between the unmanned submersible vehicles and the second communications device.

16. The method of claim 9 including:

providing a plurality of the unmanned submersible vehicles each on a respective one of a plurality of liquid petroleum product container vehicles;

providing a plurality of second communications devices each associated with and located on the same liquid petroleum product container vehicle as a respective one of the unmanned submersible vehicles, wherein each of the unmanned submersible vehicles is separated from its associated second communications device by liquid petroleum product;

providing a remote station remote from the plurality of liquid petroleum product container vehicles;

transmitting RF communication signals between each of the unmanned submersible vehicles and the associated second communications devices through the liquid petroleum product to enable wireless communications between each unmanned submersible vehicle and its associated second communications device; and transmitting communication signals between each unmanned submersible vehicle and the remote station via a communication link through the unmanned submersible vehicle's associated second communications device.

17. The method of claim 8 wherein the liquid petroleum product is a liquid petroleum fuel product.

18. The method of claim 8 including transmitting the RF communication signals between the first communications device and the second communications device at a carrier frequency that is substantially non-coupling with respect to the liquid petroleum product.

19. The method of claim 8 including transmitting the RF communication signals between the first communications device and the second communications device with a signal with a carrier frequency in the UHF band.

20. The method of claim 8 wherein the first communications device includes a sensor, and the method includes:

sensing an environmental condition, an object, and/or an emanation from the object using the sensor; and transmitting data representing the environmental condition, object and/or emanation from the first communications device to the second communications device through the liquid petroleum product.

21. The method of claim 8 wherein first communications device includes an imaging device, and the method includes:

capturing an image using the imaging device; and transmitting data representing the image from the first communications device to the second communications device through the liquid petroleum product.

22. The method of claim 8 including autonomously navigating the unmanned submersible vehicle within the liquid petroleum product.

* * * * *